US008523174B2

(12) United States Patent
Bryl et al.

(10) Patent No.: US 8,523,174 B2
(45) Date of Patent: Sep. 3, 2013

(54) MEDIA ROTATION AND TRANSLATION MECHANISM

(75) Inventors: Derek A Bryl, Webster, NY (US); Adam D Ledgerwood, Geneva, NY (US); Aaron M Moore, Fairport, NY (US); Matthew M Storey, Rochester, NY (US)

(73) Assignee: Xerox Corporation, Norwalk, CT (US)

( * ) Notice: Subject to any disclaimer, the term of this patent is extended or adjusted under 35 U.S.C. 154(b) by 41 days.

(21) Appl. No.: 13/030,503

(22) Filed: Feb. 18, 2011

(65) Prior Publication Data

US 2012/0211938 A1 Aug. 23, 2012

(51) Int. Cl.
*B65H 29/00* (2006.01)

(52) U.S. Cl.
USPC ..... 271/184; 271/272; 271/225

(58) Field of Classification Search
USPC ..... 271/264, 270, 314, 228, 272, 184, 271/185, 273–274, 121, 125; 198/608, 624
See application file for complete search history.

(56) References Cited

U.S. PATENT DOCUMENTS

| | | | | |
|---|---|---|---|---|
| 3,175,824 | A * | 3/1965 | Albosta | 271/251 |
| 3,218,060 | A * | 11/1965 | Harbison | 271/4.04 |
| 5,074,546 | A * | 12/1991 | Hanna et al. | 271/251 |
| 6,811,152 | B2 * | 11/2004 | Delfosse et al. | 271/225 |
| 7,552,926 | B2 * | 6/2009 | Van Soest | 271/273 |

* cited by examiner

*Primary Examiner* — Thomas Morrison

(57) ABSTRACT

An improved rotator/translator mechanism includes multiple thin discs that mate with an idler roll to distribute nip pressure and spin at different rotational velocities to produce the same linear velocity at the nip and thereby reduce marking on certain media.

5 Claims, 3 Drawing Sheets

MEDIA ROTATION AND TRANSLATION MECHANISM

CROSS REFERENCE TO RELATED APPLICATION

Cross-reference is hereby made to commonly assigned and copending U.S. application Ser. No. 13/030,514, filed Feb. 18, 2011, and entitled "MEDIA ROTATION AND TRANSLATION APPARATUS" by Matthew Michael Roemer Storey, et al. The disclosure of the heretofore-mentioned application is incorporated herein by reference in its entirety.

BACKGROUND

1. Field of the Disclosure

The present disclosure relates broadly to a finisher transport module system, and more particularly, to an improved rotator and translator mechanism for use in controlling the orientation and alignment of sheets passing through a finisher transport module.

2. Description of Related Art

Finishing transport module systems for rotating and translating sheets passing through the system are known, for example, U.S. Pat. No. 6,811,152 which is incorporated herein by reference along with the references cited therein. Another example is shown in prior art FIG. 1, where a sheet rotator and translator mechanism for a finishing transport module 10 includes two rotator disc motors 30 and 32 that drive each rotator disc 12 and 14 independently. When turning in the same direction and at the same speed, the sheet will pass through the rotator device like any normal nip set (no rotation or directional offset). With the motors still rotating in the same direction and speed, steering idlers 16 and 18 can be rotated around the periphery of the discs to alter the inboard/outboard position of a sheet without rotation. This is useful for offsetting sheet sets in a stacker or for changing center and edge registration for finishing devices located downstream. To know when the sheet has been offset the desired amount, there is an edge sensor 40 that is positionable by a lead screw. The lead screw motor 33 positions the sensor 40 a set distance inboard/outboard for one sheet set, then repositions the sensor to detect the inboard/outboard position for the next sheet set. For sheet rotation, the motors controlling the rotator discs simply spin at different velocities. The larger the velocity differential, the faster the media is rotated.

A problem with this design is that the discs spin horizontally while the idlers spin vertically. Therefore, if the idler were to ride along a wide nip (like normal nip sets) there would be a relative motion issue. Prior art FIG. 2 illustrates a top view of a wide disc nip design that includes a disc 45 that forms a nip with idler 46. It can be seen that with R1 being far smaller than R2 there would be a significant relative motion problem. This would result in heavy marking, slip, unreliable rotation and translation, etc. To fix this, a very thin, high-pressure nip is used. The high pressure nip is shown in prior art FIG. 1 and includes a very small contact point or ridge 13 between disc 12 and the idler 18 and 15 between disc 14 and idler 16. This effectively removes the relative motion since there is essentially only one radius, but the pressure is very high. This high pressure is necessary to prevent slip, but ultimately does cause marking on certain media, especially coated sheets.

Thus, there is a need for a solution to the problem of the tendency of existing finishing transport module systems to mark certain types of coated media.

BRIEF SUMMARY OF THE DISCLOSURE

Accordingly, in answer to the above-mentioned problem and disclosed herein is an improved rotator/translator mechanism that includes multiple thin discs that mate with an idler roll to distribute nip pressure and spin at different rotational velocities to produce the same linear velocity at the nip, thereby addressing and reducing the marking issue.

BRIEF DESCRIPTION OF THE DRAWINGS

Various of the above-mentioned and further features and advantages will be apparent to those skilled in the art from the specific apparatus and its operation or methods described in the example(s) below, and the claims. Thus, they will be better understood from this description of these specific embodiment(s), including the drawing figures (which are approximately to scale) wherein:

DETAILED DESCRIPTION OF THE PREFERRED EMBODIMENT

Figure 1:
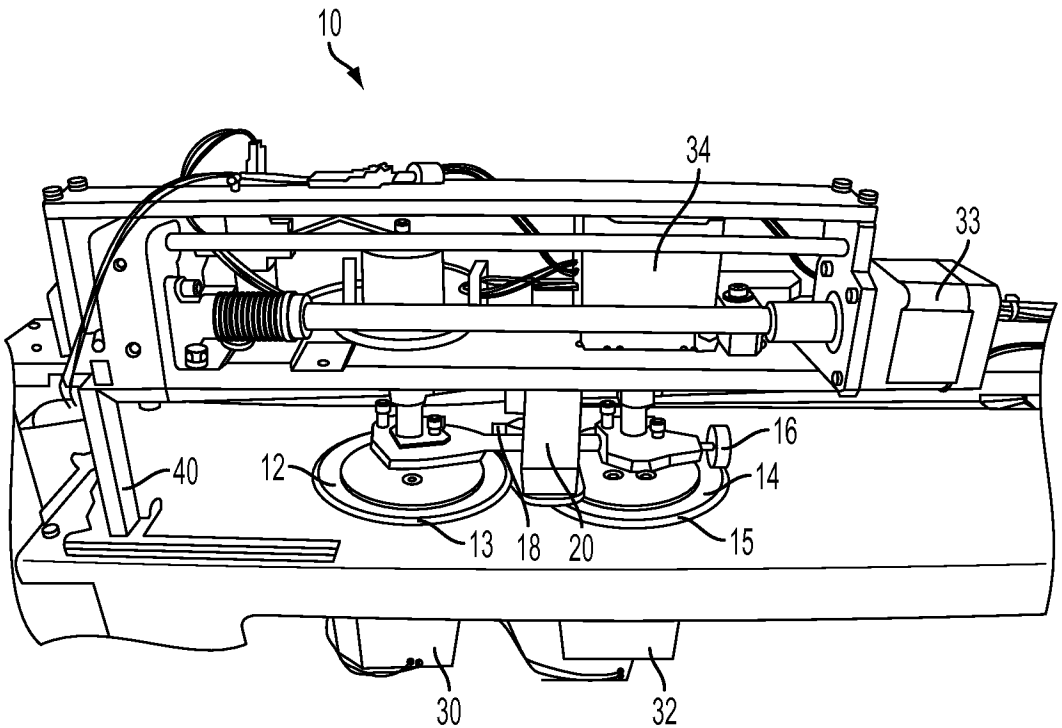
FIG. 1 PRIOR ART
FIG. 1 is a partial frontal view of a prior art sheet rotator/translator mechanism for use in a finisher transport module.
Figure 2:
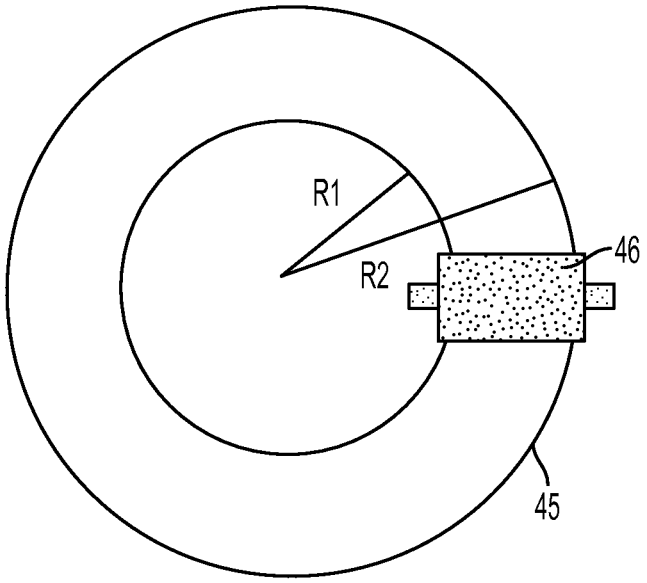
FIG. 2 PRIOR ART
FIG. 2 is a partial plan view of a prior art disc/idler roll nip configuration.
Figure 3:
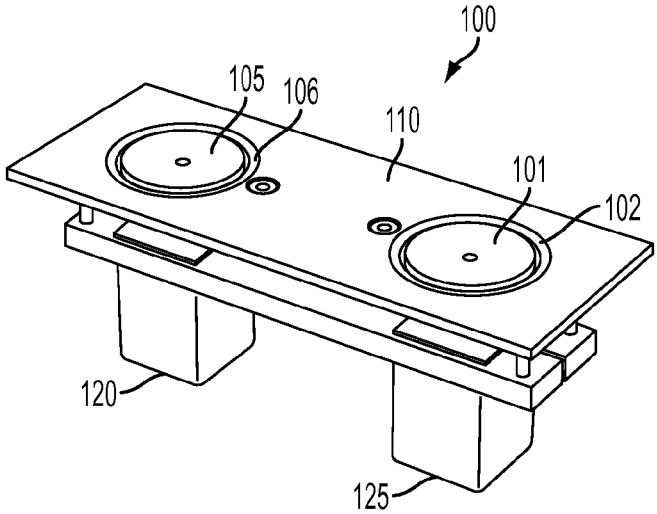
FIG. 3 is a partial perspective view of an improved sheet rotator/translator mechanism in accordance with the present disclosure.

Turning now to the drawings wherein the showings are for the purpose of illustrating an exemplary embodiment and not intended as a limitation, FIG. 3 illustrates a partial perspective view of an improved sheet rotator/translator mechanism in accordance with the present disclosure for accomplishing the sheet rotation and translation in a finisher transport module system.

Figure 4:
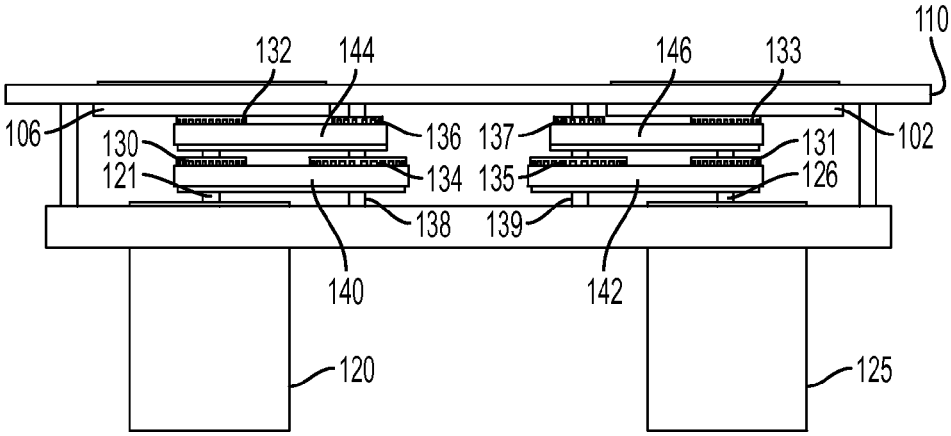
FIG. 4 is a partial frontal view of the improved sheet rotator/translator mechanism shown in FIG. 3.

A number of existing finishing transport module systems employ a media rotation and translation mechanism that utilizes two disc/idler pairs for re-registering conveyed sheets from center to side registration. However, the nip width between the disc and idler is thin relative to the diameter of the disk to avoid slippage, and the resulting high nip pressure has caused marking on coated media. In accordance with the present disclosure, the one thin disc has been replaced with multiple concentric thin discs that distribute nip pressure and spin at different rotational velocities to produce the same linear velocity at the nip and thereby reduce marking of coated media. As shown in FIGS. 3 and 4, a sheet rotator/translator mechanism 100 includes at least two discs that form a nip with an idler. They each have a small ridge or contact point thereon between the discs and idler, but as the number of contact points increase, the pressure at each is reduced. It is feasible that more than two discs could be used, if desired. For each disc added, a different radius of contact will be introduced. Therefore, the discs cannot spin at the same velocity or there will once again be a differential velocity issue for the linear motion of the media. To prevent adding more motors, the extra disc(s) are geared off the same drive motor to compensate for the varied radii.

That is, inner discs 105 and 101 supported in platform 110 are mounted to motor shafts 121 and 126 and drivingly connected to motors 120 and 125, respectively. Gear 130 is mounted directly to motor shaft 121 while gear 131 is mounted directly to motor shaft 126. Outer discs 106 and 102 are mounted to bearings and therefore spin freely about respective motor shafts 121 and 126. Outer discs 106 and 102 are also attached to the gears 132 and 133, respectively. Finally, external shafts 138 and 139 are attached to gears (134, 136) and (135, 137), respectively. As shown in FIG. 4, gears 130 and 131 through belts 140, 142, 144 and 146 drive external shafts 138 and 139 which in turn drives the gears (134, 136) and (135, 137) and outer discs 106 and 102. External shafts 138 and 139 allow for the necessary speed adjustments to take place, such that, each inner and outer disc set rotate at different velocities with matched linear velocities. Thus, when paper is fed through the nip, there will be no relative motion issues regardless of the motor velocity or the nip position yet the pressure at each contact point is reduced and marking is eliminated.

It should now be understood that an improved rotator/translator mechanism has been disclosed for use in a finishing transport module system that includes multiple thin discs which mate with an idler roll to distribute nip pressure and spin at different rotational velocities to produce the same linear velocity at the nip and thereby prevent marking of coated paper.

The claims, as originally presented and as they may be amended, encompass variations, alternatives, modifications, improvements, equivalents, and substantial equivalents of the embodiments and teachings disclosed herein, including those that are presently unforeseen or unappreciated, and that, for example, may arise from applicants/patentees and others. Unless specifically recited in a claim, steps or components of claims should not be implied or imported from the specification or any other claims as to any particular order, number, position, size, shape, angle, color, or material.

What is claimed is:

1. A finisher transport module having a rotator and translator device for use in controlling the orientation and alignment of sheets passing through said finisher transport module in a predetermined paper path, comprising:

a pair of closely spaced rotating disc sets positioned such that said sheets pass over upper edge portions thereof of the pair of said closely spaced rotating disc sets that are orthogonal with respect to said predetermined paper path when passing thereover in said predetermined path; and wherein each of said rotating disc sets includes at least two concentric discs with one of said at least two concentric discs positioned for rotation within a circumference of the other of said at least two concentric discs, and wherein each disc of said rotating disc sets has a different radius with a first disc of each rotating disc set being mounted on a motor shaft that is drivingly connected to a motor to rotate the first disc, and a second disc of each rotating disc set configured to rotate around its corresponding motor shaft and being drivingly connected to an external shaft, and wherein each external shaft of each rotating disc set includes two gears mounted thereon.

2. The finisher transport module of claim 1, wherein said two gears on each external shaft of each rotating disc set are connected to two gears on the corresponding motor shaft of each rotating disc set, wherein each motor shaft has its two gears mounted such that one gear rotates around the corresponding motor shaft and is connected to the corresponding second disc of its corresponding rotating disc set, and the other gear is fixed to the corresponding motor shaft of its corresponding rotating disc set to rotate therewith to allow for speed adjustments to take place such that said first and second discs of each of said rotating disc sets rotate at different velocities with matched linear velocities.

3. The finisher transport module of claim 1, wherein said second disc of each of said rotating disc sets is mounted to spin freely about its corresponding motor shaft.

4. A method for controlling the orientation and alignment of sheets passing through a finisher transport module that includes a rotator and translator device with the sheets being conveyed in a predetermined paper path, comprising:

providing a pair of closely spaced rotating disc sets positioned such that said sheets pass over upper edge portions thereof of the pair of said closely spaced rotating disc sets that are orthogonal with respect to said predetermined paper path when passing thereover in said predetermined path; and providing each of said rotating disc sets with at least two concentric discs with one of said at least two concentric discs positioned for rotation within a circumference of the other of said at least two concentric discs, and wherein each disc of said disc sets has a different radius with a first disc of each rotating disc set being mounted on a motor shaft that is drivingly connected to a motor to rotate the first disc, and a second disc of each rotating disc set configured to rotate around its corresponding motor shaft and being drivingly connected to an external shaft, and wherein each external shaft of each rotating disc set includes two gears mounted thereon.

5. The method of claim 4, including connecting said two gears on each external shaft of each rotating disc set to two gears on the corresponding motor shaft of each rotating disc set, wherein each motor shaft has its two gears mounted such that one gear rotates around the corresponding motor shaft and is connected to the corresponding second disc of its corresponding rotating disc set, and the other gear is fixed to the corresponding motor shaft of its corresponding rotating disc set to rotate therewith to allow for speed adjustments to take place such that said first and second discs of each of said rotating disc sets rotate at different velocities with matched linear velocities.

* * * * *